US011804186B2

(12) United States Patent
Lee et al.

(10) Patent No.: US 11,804,186 B2
(45) Date of Patent: Oct. 31, 2023

(54) DISPLAY APPARATUS HAVING POWER SUPPLY DEVICE, AND CONTROL METHOD THEREOF

(71) Applicant: SAMSUNG ELECTRONICS CO., LTD., Suwon-si (KR)

(72) Inventors: Jiwon Lee, Suwon-si (KR); Sungyong Joo, Suwon-si (KR); Junhyun Won, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/573,937

(22) Filed: Jan. 12, 2022

(65) Prior Publication Data

US 2023/0056903 A1 Feb. 23, 2023

Related U.S. Application Data

(63) Continuation of application No. PCT/KR2021/018129, filed on Dec. 2, 2021.

(30) Foreign Application Priority Data

Aug. 20, 2021 (KR) ..... 10-2021-0110498

(51) Int. Cl.
*G09G 3/34* (2006.01)

(52) U.S. Cl.
CPC ..... *G09G 3/3406* (2013.01); *G09G 2310/08* (2013.01); *G09G 2320/064* (2013.01); *G09G 2330/021* (2013.01)

(58) Field of Classification Search
CPC ..... G09G 3/2092–2096; G09G 3/34–3426; G09G 3/36–3696;
(Continued)

(56) References Cited

U.S. PATENT DOCUMENTS 7,478,254 B2 1/2009 Kawai
9,152,889 B2 10/2015 Kim
(Continued)

FOREIGN PATENT DOCUMENTS

CN 102421224 A 4/2012
CN 103533705 A 1/2014
(Continued)

OTHER PUBLICATIONS

International Search Report (PCT/ISA/210) dated May 20, 2022 by the International Searching Authority in counterpart International Application No. PCT/KR2021/018129.
(Continued)

*Primary Examiner* — Keith L Crawley
(74) *Attorney, Agent, or Firm* — Sughrue Mion, PLLC

(57) ABSTRACT

A display apparatus includes a power supply device. The power supply device includes a power supply part and an integrated circuit chip. The power supply part outputs a first power to drive a backlight and a second power to drive a main circuit. The integrated circuit chip increases, based on a control signal to adjust a brightness of the backlight being received, a current value of the second power, and reduces, based on the control signal not being received for a first threshold time, the current value of the second power.

17 Claims, 8 Drawing Sheets

(58) Field of Classification Search
CPC .. G09G 2320/062–0653; G09G 2330/02–028; G02F 1/1336–133604; G02F 1/133612; G02F 1/133626; G06F 1/26–3218; G06F 1/3265; G06F 1/3296; H02M 1/322; H02M 3/156–1566; H02M 3/335–33561; H05B 45/00–60; Y02B 70/10
See application file for complete search history.

(56) References Cited

U.S. PATENT DOCUMENTS

| | | | | |
|---|---|---|---|---|
| 9,161,412 | B2 | 10/2015 | Lou et al. | |
| 10,176,764 | B2 | 1/2019 | Jang et al. | |
| 2006/0114698 | A1* | 6/2006 | Hatakeyama | H02M 3/33523 363/20 |
| 2006/0232221 | A1 | 10/2006 | Kawai | |
| 2007/0171582 | A1* | 7/2007 | Lin | H02M 3/33561 361/18 |
| 2012/0075359 | A1* | 3/2012 | Kwak | H02M 1/4208 345/212 |
| 2012/0194078 | A1* | 8/2012 | Ren | H05B 45/3725 315/122 |
| 2016/0358553 | A1* | 12/2016 | Jang | H05B 45/355 |
| 2022/0262322 | A1* | 8/2022 | Pang | H05B 45/34 |
| 2022/0418070 | A1* | 12/2022 | Pang | H05B 45/382 |
| 2023/0162652 | A1 | 5/2023 | Lee et al. | |

FOREIGN PATENT DOCUMENTS

| | | | | |
|---|---|---|---|---|
| CN | 105744682 | A | | 7/2016 |
| CN | 210245032 | U | * | 4/2020 |
| JP | 2003-345294 | A | | 12/2003 |
| JP | 2006-280184 | A | | 10/2006 |
| JP | 6341378 | B2 | | 6/2018 |
| JP | 6732513 | B2 | | 7/2020 |
| KR | 10-0218513 | B1 | | 9/1999 |
| KR | 101365602 | B1 | | 3/2014 |
| KR | 10-2018-0009023 | A | | 1/2018 |
| KR | 1020190128323 | A | | 11/2019 |
| KR | 10-2187120 | B1 | | 12/2020 |
| KR | 10-2022-0012593 | A | | 2/2022 |
| KR | 10-2389836 | B1 | | 4/2022 |

OTHER PUBLICATIONS

Written Opinion (PCT/ISA/237) dated May 20, 2022 by the International Searching Authority in counterpart International Application No. PCT/KR2021/018129.

* cited by examiner

DISPLAY APPARATUS HAVING POWER SUPPLY DEVICE, AND CONTROL METHOD THEREOF

CROSS-REFERENCE TO RELATED APPLICATION(S)

This application is a bypass continuation of International Application No. PCT/KR2021/018129, filed on Dec. 2, 2021, which is based on and claims priority to Korean Patent Application No. 10-2021-0110498, filed on Aug. 20, 2021, in the Korean Intellectual Property Office, the disclosures of which are incorporated by reference herein in their entireties.

BACKGROUND

Field

The disclosure relates to a display apparatus and a control method thereof. More particularly, the disclosure relates to a display apparatus which includes a power supply device configured to provide power to respective circuit configurations and a control method thereof.

Description of the Prior Art

A power supply device, for example, a switched mode power supply (SMPS) included in a display apparatus may be a device configured to supply power to respective circuit configurations inside the display apparatus. For various reasons, the power supply device may include a dummy circuit for limiting a voltage rise in the power supply device. However, because the dummy circuit may, in some cases, be constantly operated, there is a disadvantage in that the dummy circuit may consume too much power. Accordingly, there is a need to develop a circuit configuration for reducing power consumption of the dummy circuit.

SUMMARY

It is an aspect to provide a power supply device included in a display apparatus for reducing power consumption and manufacturing cost, and for enhancing safety and a control method thereof.

According to an aspect of an embodiment, there is provided a display apparatus comprising a power supply device, the power supply device comprising a power supply part configured to output a first power to drive a backlight and a second power to drive a main circuit; and an integrated circuit (IC) chip configured to increase, based on a control signal to adjust a brightness of the backlight being received, a current value of the second power, and reduce, based on the control signal not being received for a first threshold time, the current value of the second power.

The power supply part may comprise a first output end configured to output the first power; and a second output end configured to output the second power, wherein the power supply device may further comprise a dummy circuit connected to the first output end, and wherein the IC chip is configured to detect a voltage of the first output end, and prevent, based on the detected voltage being greater than or equal to a first threshold value, a voltage of the first power from rising by turning on the dummy circuit.

The dummy circuit may comprise a transistor disposed between the first output end and a ground, and the IC chip may be configured to prevent the voltage of the first power from rising by turning on the transistor based on the detected voltage being greater than or equal to the first threshold value.

The IC chip may be configured to turn off the transistor based on a voltage detected while the transistor is in a turned on state decreasing to a voltage less than the first threshold value.

The power supply part may further comprise a capacitor connected to the first output end, and the IC chip may be configured to discharge the capacitor by turning on the transistor for a second threshold time based on the detected voltage decreasing to a voltage less than a second threshold value, which is less than the first threshold value.

The display apparatus may further comprise a feedback circuit connected to the second output end, wherein the feedback circuit is configured to provide a feedback signal to the power supply part based on a voltage magnitude of the second output end.

The control signal may comprise at least one of a pulse width modulation signal or an amplitude dimming signal.

The control signal may be received by the IC chip according a user command for turning on the display apparatus.

The IC chip may be configured to change an operation mode of the display apparatus to a first mode by increasing the current value of the second power, and change the operation mode of the display apparatus to a second mode by reducing the current value of the second power.

The first mode may be a normal mode, and the second mode may be a low power mode.

According to another aspect of an embodiment, there is provided a control method of a display apparatus, the control method comprising outputting, by a power supply part, a first power to drive a backlight and a second power to drive a main circuit; and increasing, by an integrated circuit (IC) chip, a current value of the second power based on a control signal to adjust a brightness of the backlight, and reducing, based on the control signal not being received for a first threshold time, the current value of the second power.

The method may further comprise detecting, by the IC chip, a voltage of a first output end of the power supply part, the first output end being configured to output the first power; and preventing, based on the detected voltage being greater than or equal to a first threshold value, a voltage of the first power from rising by turning on, by the IC chip, a dummy circuit connected to the first output end.

The preventing may comprise turning on, by the IC chip, a transistor in the dummy circuit, and the transistor may be disposed between the first output end and a ground.

The method may further comprise turning off, by the IC chip, the transistor based on the voltage detected while the transistor is in a turned on state decreasing to a voltage less than the first threshold value.

The method may further comprise discharging, based on the detected voltage decreasing to a voltage less than a second threshold value, a capacitor in the power supply part by turning on, by the IC chip, the transistor for a second threshold time, wherein the second threshold value is less than the first threshold value, and wherein the capacitor is connected to the first output end.

According to another aspect of an embodiment, there is provided a display apparatus comprising a power supply device, the power supply device comprising a power supply part configured to output a first power to drive a backlight and a second power to drive a main circuit; and an integrated circuit (IC) chip configured to change an operation mode of the display apparatus to a low power mode from a normal mode, based on a control signal to adjust a brightness of the backlight not being received for a first threshold time.

The IC chip may change the operation mode to the low power mode by reducing a current value of the second power.

The power supply part may comprise a first output end configured to output the first power; and a second output end configured to output the second power, wherein the power supply device further comprises a dummy circuit connected to the first output end and comprising a transistor disposed between the first output end and a ground, and wherein the IC chip is configured to detect a voltage of the first output end, and prevent, based on the detected voltage being greater than or equal to a first threshold value, a voltage of the first power from rising by turning on the transistor.

The IC chip may be configured to turn off the transistor based on a voltage detected while the transistor is in a turned on state decreasing to a voltage less than the first threshold value.

The power supply part may further comprise a capacitor connected to the first output end, wherein the IC chip is configured to discharge the capacitor by turning on the transistor for a second threshold time based on the detected voltage decreasing to a voltage less than a second threshold value, which is less than the first threshold value.

According to the various embodiments as described above, the manufacturing cost of the power supply device included in the display apparatus may be reduced because some configurations are removed compared to circuits of the related art, and power consumption may be reduced by operating at the low power mode based on the control signal of the main circuit.

In addition, the power supply device included in the display apparatus may reduce power consumption and the heat generated because the dummy circuit is not constantly operated, and enhance safety by discharging unnecessary overvoltage through the dummy circuit.

DETAILED DESCRIPTION

The disclosure will be explained in greater detail below with reference to the accompanying drawings.

The terms used in describing the various embodiments of the disclosure are general terms selected that are currently widely used considering their function herein. However, the terms may change depending on intention, legal or technical interpretation, emergence of new technologies, and the like of those skilled in the related art. Further, in certain cases, there may be terms arbitrarily selected, and in this case, the meaning of the term will be disclosed in greater detail in the corresponding description. Accordingly, the terms used herein are not to be understood simply as its designation but based on the meaning of the term and the overall context of the disclosure.

In the disclosure, expressions such as "comprise," "may comprise," "include," "may include," or the like are used to designate a presence of a corresponding characteristic (e.g., elements such as numerical value, function, operation, or component, etc.), and not to preclude a presence or a possibility of additional characteristics.

The expression "at least one of A and/or B" is to be understood as indicating at least one of "A" or "B" or "A and B."

Expressions such as "first," "second," "1st," "2nd," or so on used herein may be used to refer to various elements regardless of order and/or importance. Further, it should be noted that the expressions are merely used to distinguish an element from another element and not to limit the relevant elements.

A singular expression includes a plural expression, unless otherwise specified. It is to be understood that the terms such as "comprise" or "include" are used herein to designate a presence of a characteristic, number, step, operation, element, component, or a combination thereof, and not to preclude a presence or a possibility of adding one or more of other characteristics, numbers, steps, operations, elements, components or a combination thereof.

In the disclosure, the term "user" may refer to a person using an electronic apparatus or a device (e.g., artificial intelligence electronic apparatus) using an electronic apparatus.

As discussed above, a power supply device, for example, a switched mode power supply (SMPS), included in a display apparatus may be a device configured to supply power to respective circuit configurations inside the display apparatus.

Figure 1A:
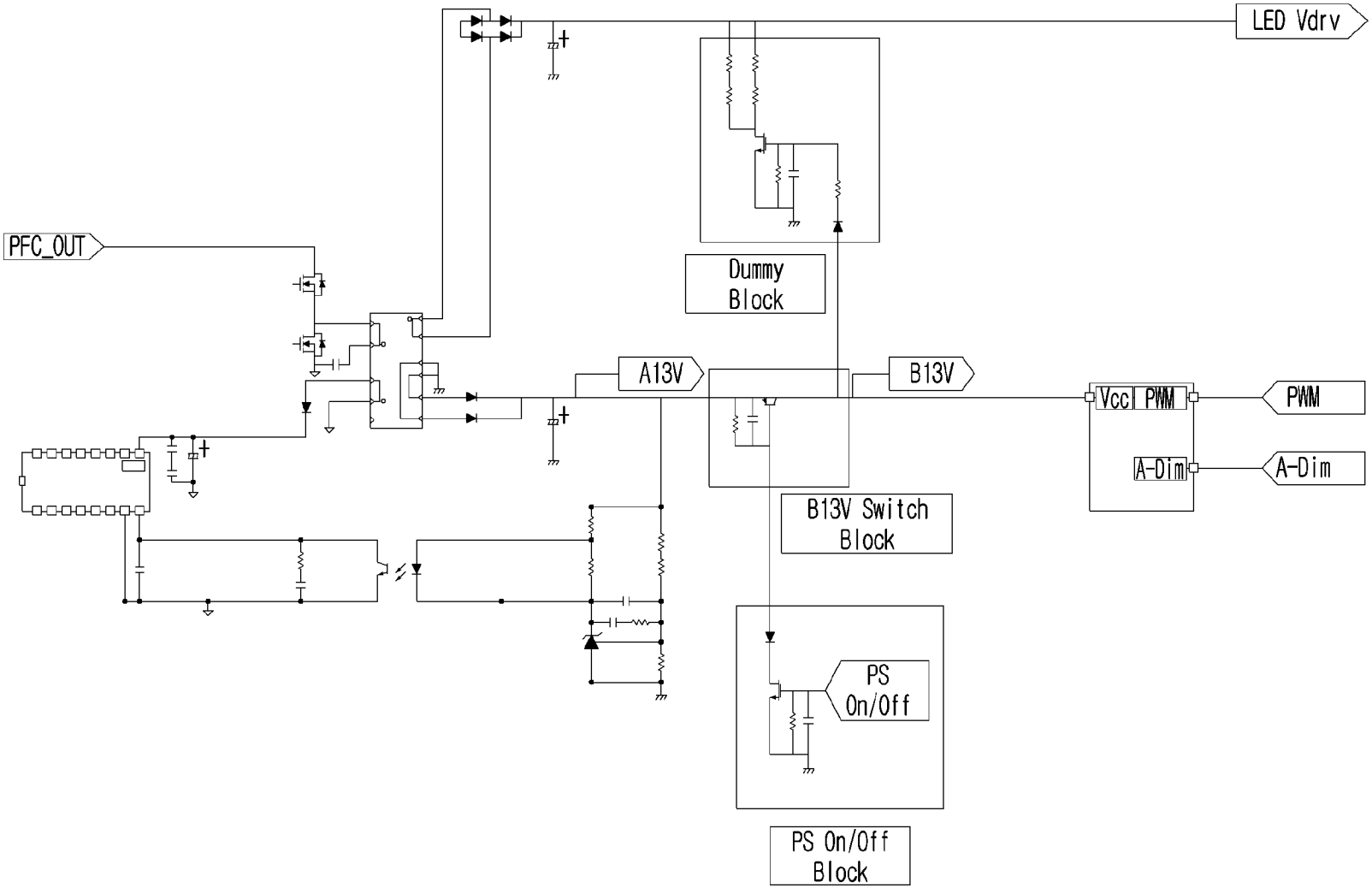
FIG. 1A and FIG. 1B are diagrams illustrating related art to assist in the understanding of the disclosure.

For example, a power supply device illustrated in FIG. 1A may include one feedback circuit in a direct current (DC)-DC converter, and the feedback circuit may be configured to perform feedback on a voltage of an A13V node.

The power supply device may be configured to control a B13V Switch Block by receiving a PS On/Off signal, and based on a B13V Switch Block being in a conducting state, the A13V node and an B13V node may conduct and a dummy circuit (dummy block) may be operated.

Figure 1B:
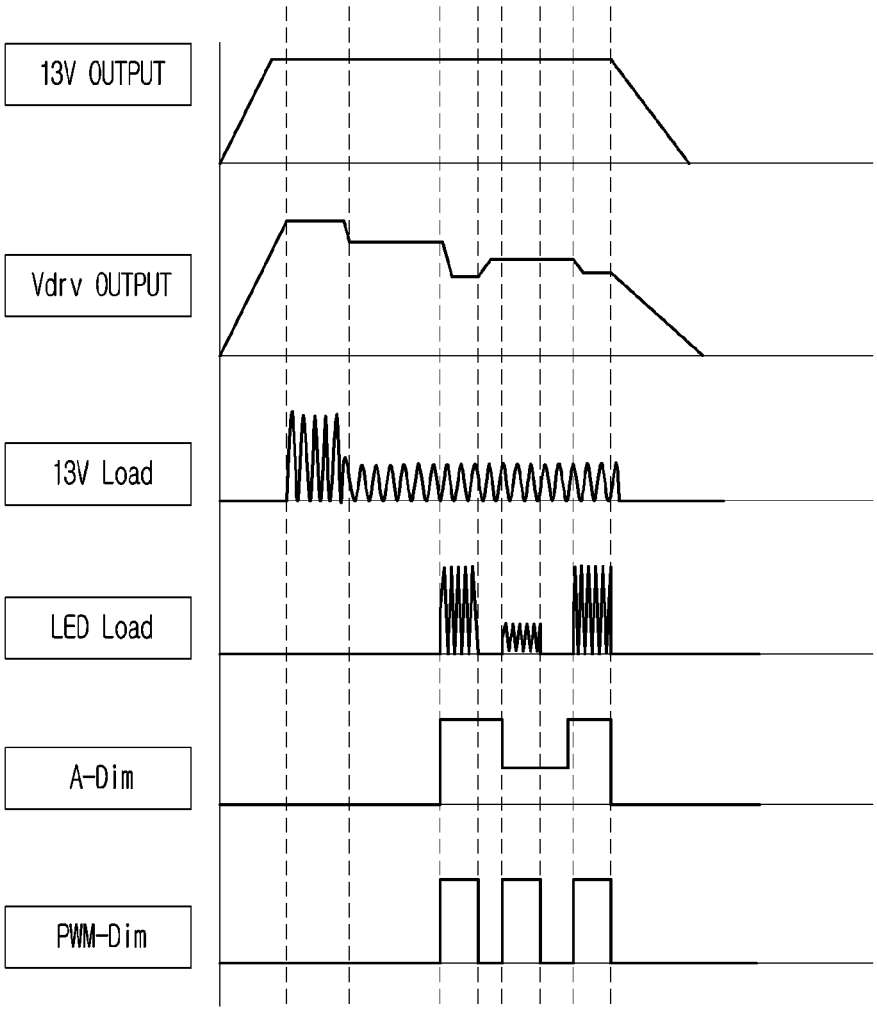

As illustrated in FIG. 1B, the voltage of the A13V node may have a small voltage variation through a feedback operation by the feedback circuit. On the other hand, a Vdrv voltage (LED Vdrv) may have a relatively large voltage variation according to a 13V load and an LED load because there is no feedback circuit.

The dummy circuit may be used for the purpose of limiting a Vdrv voltage rise. However, because the dummy circuit is constantly operated after the PS On signal is input, there is a disadvantage that the dummy circuit consumes power even when the Vdrv voltage is not in a rising state.

Various embodiments disclosed here provide a display apparatus having an improved dummy circuit.

The disclosure will be described in greater detail below with reference to the accompanied drawings.

Figure 2:
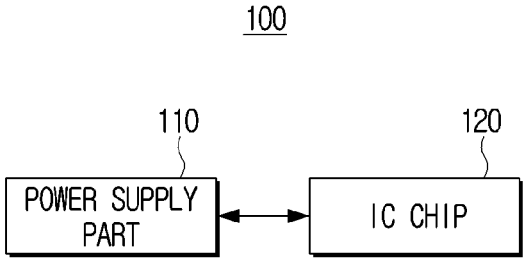
FIG. 2 is a block diagram illustrating a configuration of a display apparatus according to an embodiment.

FIG. 2 is a block diagram illustrating a configuration of a display apparatus 100 according to an embodiment. As illustrated in FIG. 2, the display apparatus 100 may include a power supply part 110 and an integrated circuit (IC) chip 120. Alternatively, in some embodiments, the display apparatus 100 may include a power supply device, and the power supply device may include the power supply part 110 and the integrated circuit (IC) chip 120.

The power supply device may be a device configured to provide power to respective circuit configurations by generating power. For example, the power supply device may be configured to provide, as a configuration of the display apparatus 100, power to the respective circuit configurations included in the display apparatus 100.

However, the embodiment is not limited thereto, and in some embodiments, the power supply device may be realized as a separate device, and in this case, the power supply device may be configured to provide power to the respective circuit configurations included in an external device.

The power supply part 110 may be configured to output a first power for driving a backlight and a second power for driving a main circuit. The power supply part 110 may include a first output end outputting the first power and a second output end outputting the second power, and the first output end may be connected with the backlight and the second output end may be connected with the main circuit. In addition, a feedback circuit connected to the second output end may be configured to provide a feedback signal to the power supply part 110 based on a voltage magnitude of the second output end, and accordingly, the power supply part 110 may be configured to maintain the second power at a certain magnitude. That is, a variation width of the second power may be smaller than a variation width of the first power.

However, the embodiment is not limited thereto, and the first power and the second power may be provided to other circuit configurations other than the backlight and the main circuit, respectively.

The integrated circuit (IC) chip 120 may be configured to increase, based on a control signal for adjusting the brightness of the backlight being received from the main circuit, a current value of the second power, and reduce, based on the control signal not being received from the main circuit for a first threshold time or more, a current value of the second power. The control signal may include at least one of a pulse width modulation (PWM) signal or an amplitude dimming (A-Dim) signal. In addition, in some embodiments, the control signal may be output from the main circuit to the IC chip 120 according to a user command to turn on the display apparatus.

For example, the IC chip 120 may be configured to change an operation mode of the display apparatus to a first mode by increasing the current value of the second power based on the control signal being received, and change, based on the control signal not being received for the first threshold time or more, the operation mode of the display apparatus to a second mode by reducing the current value of the second power. The first mode may be a normal mode, and the second mode may be a low power mode.

That is, the power supply device may be configured such that the operation mode is changeable by the IC chip 120 based on the control signal of the main circuit even if the PS On signal of the related art is not received, and accordingly, the power supply device may be operable without the PS On/Off Block of the related art.

The power supply device may further include a dummy circuit which is connected to the first output end, and the IC chip 120 may be configured to detect a voltage of the first output end, and prevent the voltage of the first power from rising by turning on the dummy circuit based on the detected voltage being greater than or equal to a first threshold value.

Specifically, the dummy circuit may include a transistor disposed between the first output end and the ground, and the IC chip 120 may be configured to prevent the voltage of the first power from rising by turning on the transistor based on the detected voltage rising to the first threshold value or more. That is, when the transistor is turned on and conducting, a current path from the first output end to the ground through the transistor may be formed, and accordingly, the rising of the voltage of the first power may be prevented.

The IC chip 120 may be configured to turn off the transistor based on the voltage detected while the transistor is in the turned on state decreasing to a voltage less than the first threshold value.

That is, because the IC chip 120 actively controls the dummy circuit, the A13V node and the B13V node may be in a conducting state, and the B13V Switch Block of the related art is not necessary. In addition, according to the related art, the dummy circuit was constantly operated after the PS On signal was input. By contrast, according to an embodiment, because the dummy circuit is operated only when the voltage of the first output end is greater than or equal to the first threshold value, the power consumed in the dummy circuit may be reduced as compared to the related art.

The power supply part 110 may further include a capacitor configured to connect to the first output end, and the IC chip 120 may be configured to discharge the capacitor by turning on the transistor for a second threshold time based on the detected voltage decreasing to a voltage of less than the second threshold value.

For example, even if the voltage of the first output end decreases to a voltage of less than the second threshold value, the capacitor connected to the first output end may be in a charged state, and may lead to danger in situations such as fixing the power supply device. Accordingly, based on the IC chip 120 discharging the capacitor by turning on the transistor for the second threshold time, the danger as described above may be prevented.

As described above, because the power supply device is realized without the PS On/Off Block of the related art and the B13V Switch Block of the related art, the manufacturing cost may be reduced, the power supply device may be operated at the low power mode based on the control signal of the main circuit, power consumption and heat generation may be reduced because the dummy circuit is not constantly operated, and safety may be enhanced by discharging the unnecessary overvoltage through the dummy circuit.

The circuit configuration and operation of the power supply device may be described in greater detail below with reference to FIG. 3 to FIG. 6. In FIG. 3 to FIG. 6, individual embodiments will be described as separate for convenience of description. However, the individual embodiments of FIG. 3 to FIG. 6 may be implemented in a combined state.

Figure 3:
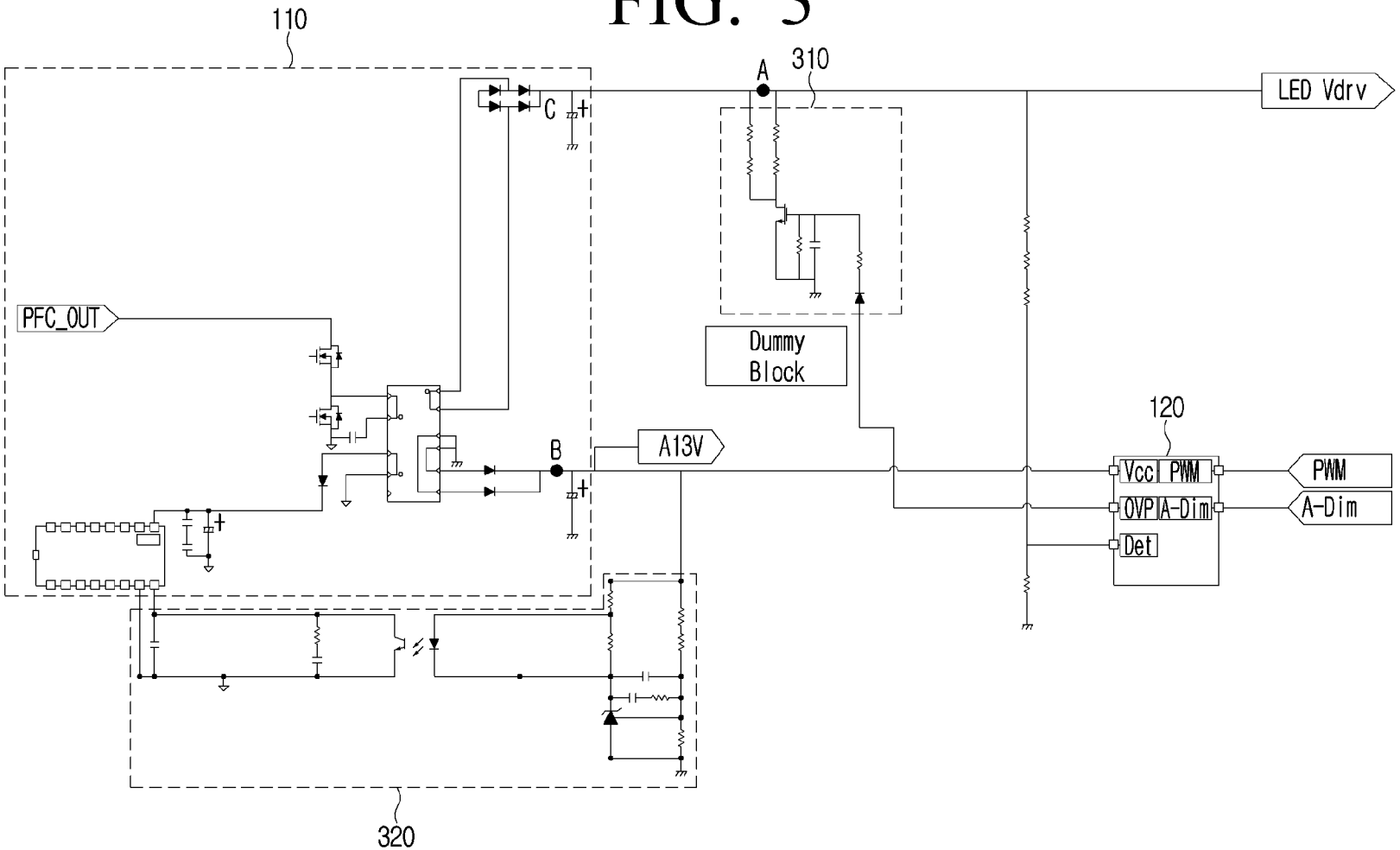
FIG. 3 is a diagram illustrating a detailed circuit of a power supply device according to an embodiment.

FIG. 3 is a diagram illustrating a detailed circuit of the power supply device according to an embodiment.

The power supply device may include a power supply part 110, an IC chip 120, a dummy circuit 310, and a feedback circuit 320. As compared with FIG. 1A, in the embodiment in FIG. 3, the PS On/Off Block of the related art and the B13V Switch Block of the related art have been removed, and the power supply device according to an embodiment may be realized without the PS On/Off Block of the related art and the B13V Switch Block of the related art.

The power supply part 110 may include the first output end outputting the first power, and the first output end may be connected with the backlight. One end of the dummy circuit and a Det terminal of the IC chip 120 may be connected to the first output end and a node A to which the backlight is connected. The IC chip 120 may be configured to detect the voltage of the first output end through the Det terminal.

The power supply part 110 may include a second output end outputting the second power, and the second output end may be connected with a Vcc terminal of the IC chip 120. The feedback circuit may be connected to the node B to which the second output end and the Vcc terminal of the IC chip 120 are connected, and provide the feedback signal to the power supply part based on the voltage magnitude of the second output end. Accordingly, the power supply part 110 may be configured to maintain the second power to a certain magnitude.

In addition, although not illustrated in FIG. 3, the main circuit may be connected to the second output end and may be supplied with the second power.

An OVP terminal of the IC chip 120 may be connected with other end of the dummy circuit. In addition, a PWM terminal of the IC chip 120 may be configured to receive a PWM signal from the main circuit, and an A-Dim terminal may be configured to receive an A-Dim signal from the main circuit. The PWM signal and the A-Dim signal may be signals for adjusting the brightness of the backlight.

The main circuit may be configured to generate at least one of the PWM signal or the A-Dim signal according to a user command to turn on the display apparatus and provide to the IC chip 120.

The IC chip 120 may be configured to increase, based on at least one of the PWM signal or the A-Dim signal being received from the main circuit, the current value of the second power and change the operation mode of the display apparatus to the normal mode. That is, the power supply device may be configured to change the operation mode even if there is no separate PS On signal. Accordingly, the PS On/Off Block of the related art may be omitted.

The IC chip 120 may be configured to detect the voltage of the first output end through the Det terminal, and turn on the dummy circuit by outputting a high voltage through the OVP terminal based on the detected voltage being greater than or equal to the first threshold value. In this case, the current path from the first output end to the ground may be formed because the transistor included in the dummy circuit is turned on and conducts, and the rising of the voltage of the first output end may be prevented.

Thereafter, the IC chip 120 may be configured to turn off the dummy circuit by outputting a low voltage through the OVP terminal based on the detected voltage decreasing to a voltage of less than or equal to the second threshold value, which is less than the first threshold value. That is, the IC chip 120 may be configured to prevent power consumption of the dummy circuit by turning off the dummy circuit after constraining the rising of the voltage of the first output end.

The power supply part 110 may further include a capacitor C which is connected to the first output end, and the IC chip 120 may be configured to turn on the dummy circuit by outputting a high voltage through the OVP terminal for the second threshold time based on the detected voltage decreasing to a voltage of less than the second threshold value, and accordingly discharge the capacitor C. Through the operation described above, accidents due to power charged to the capacitor C may be prevented.

Thereafter, the IC chip 120 may be configured to change the operation mode of the display apparatus to the low power mode by reducing the current value of the second power based on the PWM signal and the A-Dim signal not being received from the main circuit for the first threshold time or more. That is, the power supply device may be configured to change the operation mode even without a separate PS Off signal. Accordingly, as compared with the related art, the PS On/Off Block may be omitted.

Figure 4:
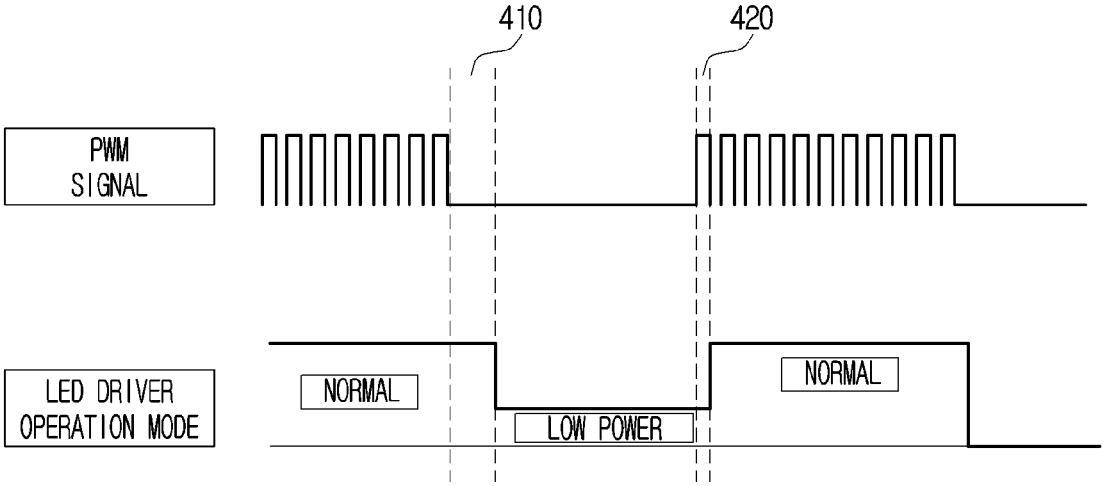
FIG. 4 is a diagram illustrating a change in operation mode by an IC chip according to an embodiment.

FIG. 4 is a diagram illustrating a change in operation mode by the IC chip 120 according to an embodiment.

As illustrated in FIG. 4, the IC chip 120 may be configured to change the operation mode of the display apparatus to the low power mode when the PWM signal is not received from the main circuit for the first threshold time 410 or more while the operation mode of the display apparatus is in the normal mode state.

Further, the IC chip 120 may be configured to change the operation mode of the electronic apparatus to the normal mode based on the PWM signal being received from the main circuit while the operation mode of the electronic apparatus is in the state of the low power mode. A delay time 420 may be generated until the operation mode is changed to the normal mode after the PWM signal is received.

Through the operation described above, the operation mode may be changed even without the PS On/Off signal. Accordingly, as compared with the related art, the PS On/Off Block may be omitted.

Although the PWM signal has been provided as an example in FIG. 4, in other embodiments, a similar operation may be achieved with the A-Dim signal.

In addition, the embodiment is not limited to the PWM signal or the A-Dim signal. In other embodiments, the IC chip 120 may be configured to change the operation of the electronic apparatus from the low power mode to the normal mode using any control signal that may be received to adjust the brightness of the backlight.

Figure 5:
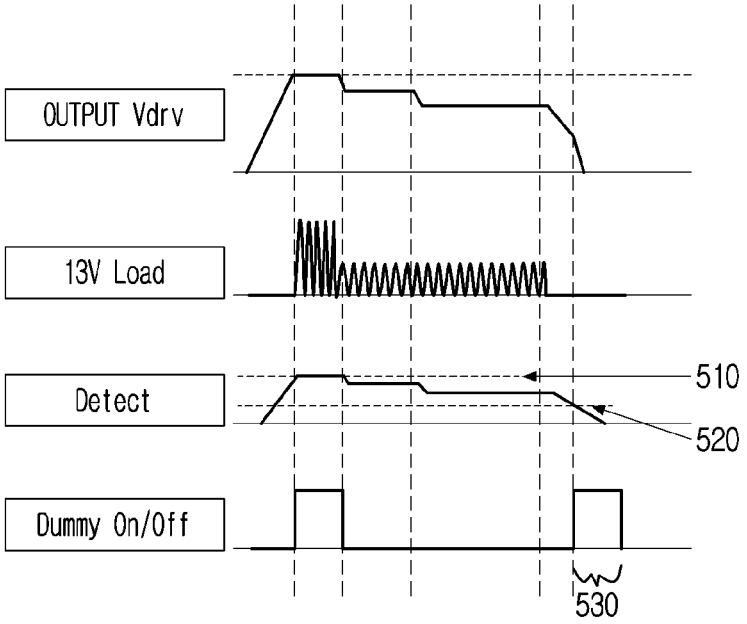
FIG. 5 is a diagram illustrating an operation of a dummy circuit according to an embodiment.

FIG. 5 is a diagram illustrating an operation of the dummy circuit according to an embodiment.

As illustrated in FIG. 5, because the voltage Vdrv of the first output end does not have a feedback circuit, a voltage variation may be generated according to the 13V load and the backlight load.

The IC chip 120 may be configured to detect the voltage of the first output end, and prevent the voltage of the first power from rising by turning on the dummy circuit based on the detected voltage being greater than or equal to the first threshold value 510. Thereafter, the IC chip 120 may be configured to turn off the dummy circuit based on the detected voltage decreasing to a voltage of less than the first threshold value 510.

The IC chip 120 may be configured to discharge the capacitor C connected to the first output end by turning on the dummy circuit for a second threshold time 530 based on the detected voltage decreasing to a voltage of less than a second threshold value 520 which is less than the first threshold value 510.

That is, the IC chip 120 may be configured to enhance safety by discharging unnecessary overvoltage through the dummy circuit.

Figure 6:
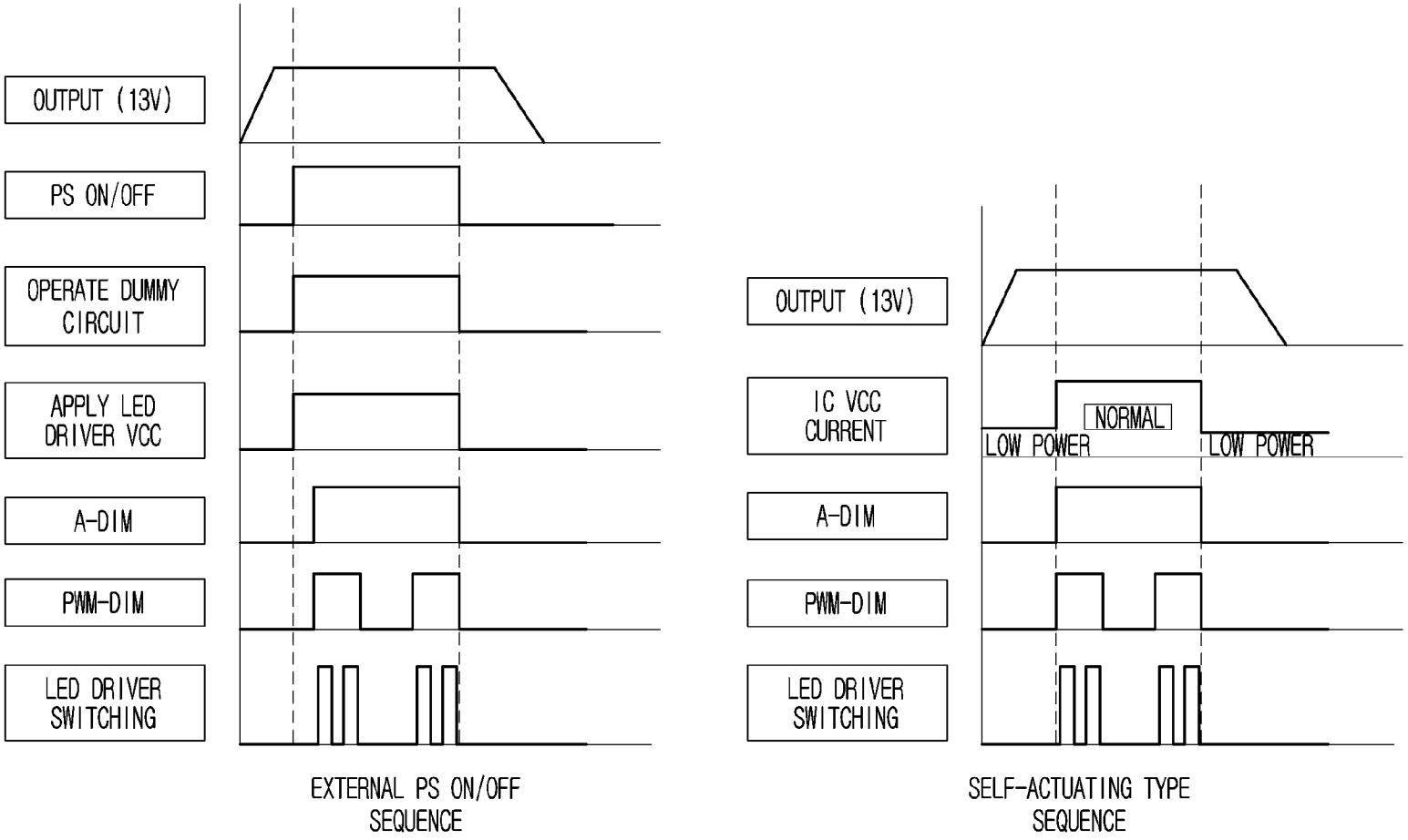
FIG. 6 is a diagram illustrating timing between main signals according to an embodiment.

FIG. 6 is a diagram illustrating a timing comparison between signals of the related art and signals according to an embodiment.

The left side of FIG. 6 illustrates timing between main signals of the related art, and the right side of FIG. 6 illustrates timing between main signals according to an embodiment.

First, there is no need for the main signal according to an embodiment to account for the PS On/Off signal, the operate dummy circuit signal, and the apply LED Driver VCC signal compared to the related art. However, the main signal accounts for the IC VCC current.

This is because the operation mode may be varied according to whether the IC chip 120 receives the control signal from the main circuit.

In addition, the display apparatus according to an embodiment may be configured such an LED Driver Switching is delayed more than the PWM signal and the A-Dim signal because the operation mode is changed according to at least one of the PWM signal or the A-Dim signal. However, the delay may not be to an extent that is recognizable to the user.

According to an embodiment as described above, power consumption may be reduced by also reducing the number of main signals.

Figure 7:
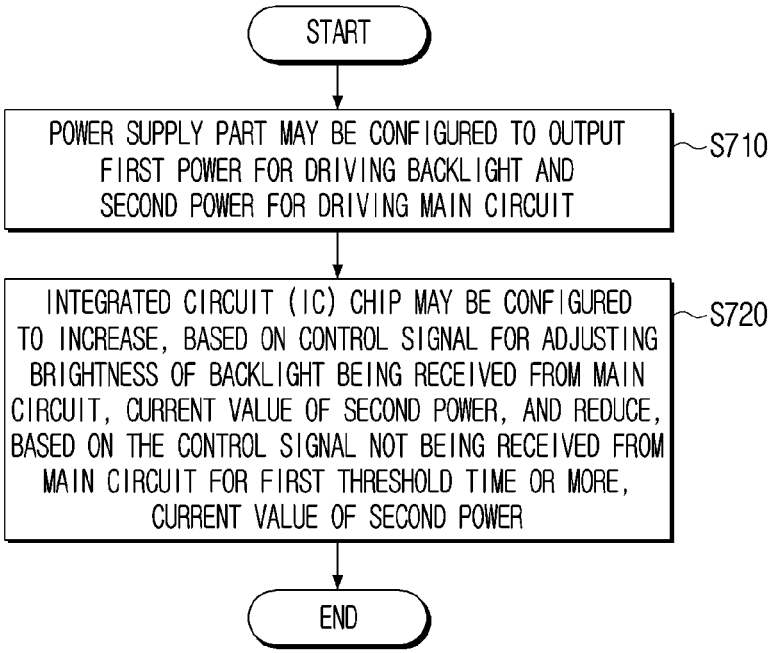
FIG. 7 is a flowchart illustrating a control method of a display apparatus according to an embodiment.

FIG. 7 is a flowchart illustrating a control method of a display apparatus according to an embodiment.

The power supply part may be configured to output the first power for driving the backlight and the second power for driving the main circuit (S710). The integrated circuit (IC) chip may be configured to increase, based on a control signal for adjusting the brightness of the backlight being received from a main circuit, the current value of the second power, and reduce, based on the control signal not being received from the main circuit for the first threshold time or more, the current value of the second power (S720).

Detecting, by the IC chip, the voltage of the first output end configured to output the first power of the power supply part and preventing, based on the detected voltage being greater than or equal to the first threshold value, the voltage of the first power from rising by turning on, by the IC chip, the dummy circuit connected to the first output end may be further included.

Further, the preventing may include preventing the voltage of the first power from rising by turning on, by the IC chip, the transistor in the dummy circuit, and the transistor may be disposed between the first output end and the ground.

In addition, the turning off, by the IC chip, the transistor based on the voltage which is detected while the transistor is in a turned on state decreasing to a voltage, which is less than the first threshold value may be further included.

Further, the discharging the capacitor in the power supply part by turning on, by the IC chip, the transistor for the second threshold time based on the detected voltage decreasing to a voltage of less than the second threshold value may be further included, and the capacitor may be connected to the first output end.

The feedback circuit connected to the second output end which outputs the second power of the power supply part providing the feedback signal to the power supply part based on the voltage magnitude of the second output end may be further included.

Further, the control signal may include at least one of the pulse width modulation (PWM) signal or the amplitude dimming (A-DIM) signal.

In addition, the control signal may be output from the main circuit to the IC chip according to the user command to turn on the display apparatus.

The reducing (S720) may include changing the operation mode of the display apparatus to the first mode by increasing, by the IC chip, the current value of the second power, and changing the operation mode of the electronic apparatus to the second mode by reducing the current value of the second power.

Here, the first mode may be the normal mode, and the second mode may be the lower power mode.

According to the various embodiments as described above, the manufacturing cost of the power supply device included in the display apparatus may be reduced because some configurations are removed compared to circuits of the related art, and power consumption may be reduced by operating at the low power mode based on the control signal of the main circuit.

In addition, the power supply device included in the display apparatus may reduce power consumption and the heat generated because the dummy circuit is not constantly operated, and enhance safety by discharging unnecessary overvoltage through the dummy circuit.

According to an embodiment, the various embodiments described above may be implemented with software including instructions stored in a machine-readable storage media (e.g., computer). The machine may be configured to call an instruction stored in the storage medium, and as a device capable of operating according to the called instruction, may include an electronic apparatus (e.g., electronic apparatus A) according to the above-mentioned embodiments. Based on the instruction being executed by the processor, the processor may directly or using other elements under the control of the processor perform a function corresponding to the instruction. The instructions may include a code generated by a compiler or executed by an interpreter. The machine-readable storage medium may be provided in the form of a non-transitory storage medium. Herein, 'non-transitory' merely means that the storage medium is tangible and does not include a signal, and the term does not differentiate data being semi-permanently stored or being temporarily stored in the storage medium. For example, the 'non-transitory storage medium' may include a buffer in which data is temporarily stored.

According to an embodiment, the method according to the various embodiments described above may be provided included a computer program product. The computer program product may be exchanged between a seller and a purchaser as a commodity. The computer program product may be distributed in the form of a machine-readable storage medium (e.g., a compact disc read only memory (CD-ROM)), or distributed online through an application store (e.g., PLAYSTORE™). In the case of online distribution, at least a portion of the computer program product (e.g., downloadable app) may be at least stored temporarily in a storage medium such as a server of a manufacturer, a server of an application store, or a memory of a relay server, or temporarily generated.

In addition, according to an embodiment, the various embodiments described above may be realized in a recordable medium which is readable by a computer or a device similar to the computer using software, hardware, or the combination of software and hardware. In some cases, embodiments described herein may be realized by the processor itself. According to a software implementation, embodiments such as the procedures and functions described herein may be realized with separate software modules. The respective software modules may perform one or more of the functions and operations described herein.

The computer instructions for performing processing operations in the device according to the various embodiments described above may be stored in a non-transitory computer-readable medium. The computer instructions stored in this non-transitory computer-readable medium may cause a specific device to perform the processing operations in the device according to the above-described various embodiments when executed by the processor of the specific device. The non-transitory computer readable medium may refer to a medium that stores data semi-permanently rather than storing data for a very short time, such as a register, a cache, a memory, or the like, and is readable by the device.

Specific examples of the non-transitory computer readable medium may include, for example, and without limitation, a compact disc (CD), a digital versatile disc (DVD), a hard disc, a Blu-ray disc, a universal serial bus (USB), a memory card, a read only memory (ROM), and the like.

In addition, each of the elements (e.g., a module or a program) according to various embodiments may be comprised of a single entity or a plurality of entities, and some sub-elements of the abovementioned sub-elements may be omitted or other sub-elements may be further included in various embodiments. Alternatively or additionally, some elements (e.g., modules or programs) may be integrated into one entity to perform the same or similar functions performed by each respective element prior to integration. Operations performed by a module, program, or other element, in accordance with various embodiments, may be performed sequentially, in parallel, repetitively, or in a heuristically manner, or at least some operations may be performed in a different order, omitted, or a different operation may be added.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A display apparatus comprising a power supply device, the power supply device comprising:

a power supply part configured to output a first power to drive a backlight and a second power to drive a main circuit; and an integrated circuit (IC) chip that is separate from the power supply part and configured to increase, based on a control signal to adjust a brightness of the backlight being received, a current value of the second power that drives the main circuit, and reduce, based on the control signal not being received for a first threshold time, the current value of the second power that drives the main circuit, wherein the power supply part comprises:

a first output end configured to output the first power; and a second output end configured to output the second power, wherein the power supply device further comprises:

a dummy circuit connected to the first output end, and wherein the IC chip is configured to detect a voltage of the first output end, and prevent, based on the detected voltage being greater than or equal to a first threshold value, a voltage of the first power from rising by turning on the dummy circuit.

2. The display apparatus of claim 1, wherein the dummy circuit comprises a transistor disposed between the first output end and a ground, and wherein the IC chip is configured to prevent the voltage of the first power from rising by turning on the transistor based on the detected voltage being greater than or equal to the first threshold value.

3. The display apparatus of claim 2, wherein the IC chip is configured to turn off the transistor based on a voltage detected while the transistor is in a turned on state decreasing to a voltage less than the first threshold value.

4. The display apparatus of claim 3, wherein the power supply part further comprises:

a capacitor connected to the first output end, wherein the IC chip is configured to discharge the capacitor by turning on the transistor for a second threshold time based on the detected voltage decreasing to a voltage less than a second threshold value, which is less than the first threshold value.

5. The display apparatus of claim 1, further comprising:

a feedback circuit connected to the second output end, wherein the feedback circuit is configured to provide a feedback signal to the power supply part based on a voltage magnitude of the second output end.

6. The display apparatus of claim 1, wherein the control signal comprises at least one of a pulse width modulation signal or an amplitude dimming signal.

7. The display apparatus of claim 1, wherein the control signal is received by the IC chip according to a user command for turning on the display apparatus.

8. The display apparatus of claim 1, wherein the IC chip is configured to:

change an operation mode of the display apparatus to a first mode by increasing the current value of the second power, and change the operation mode of the display apparatus to a second mode by reducing the current value of the second power.

9. The display apparatus of claim 8, wherein the first mode is a normal mode, and the second mode is a low power mode.

10. A control method of a display apparatus, the control method comprising:

outputting, by a power supply part, a first power to drive a backlight and a second power to drive a main circuit; and increasing, by an integrated circuit (IC) chip that is separate from the power supply part, a current value of the second power that drives the main circuit based on a control signal to adjust a brightness of the backlight, and reducing, based on the control signal not being received for a first threshold time, the current value of the second power that drives the main circuit, detecting, by the IC chip, a voltage of a first output end of the power supply part, the first output end being configured to output the first power; and preventing, based on the detected voltage being greater than or equal to a first threshold value, a voltage of the first power from rising by turning on, by the IC chip, a dummy circuit connected to the first output end.

11. The control method of claim 10, wherein the preventing comprises turning on, by the IC chip, a transistor in the dummy circuit, and the transistor is disposed between the first output end and a ground.

12. The control method of claim 11, further comprising:

turning off, by the IC chip, the transistor based on the voltage detected while the transistor is in a turned on state decreasing to a voltage less than the first threshold value.

13. The control method of claim 12, further comprising:

discharging, based on the detected voltage decreasing to a voltage less than a second threshold value, a capacitor in the power supply part by turning on, by the IC chip, the transistor for a second threshold time, wherein the second threshold value is less than the first threshold value, and wherein the capacitor is connected to the first output end.

14. A display apparatus comprising a power supply device, the power supply device comprising:

a power supply part configured to output a first power to drive a backlight and a second power to drive a main circuit; and an integrated circuit (IC) chip that is separate from the power supply part and configured to change an operation mode of the display apparatus to a low power mode from a normal mode by changing a current value of the second power that drives the main circuit, based on a control signal to adjust a brightness of the backlight not being received for a first threshold time, wherein the power supply part comprises:

a first output end configured to output the first power; and a second output end configured to output the second power, wherein the power supply device further comprises:

a dummy circuit connected to the first output end and comprising a transistor disposed between the first output end and a ground, and wherein the IC chip is configured to detect a voltage of the first output end, and prevent, based on the detected voltage being greater than or equal to a first threshold value, a voltage of the first power from rising by turning on the transistor.

15. The display apparatus of claim 14, wherein the IC chip changes the operation mode to the low power mode by reducing the current value of the second power.

16. The display apparatus of claim 14, wherein the IC chip is configured to turn off the transistor based on a voltage detected while the transistor is in a turned on state decreasing to a voltage less than the first threshold value.

17. The display apparatus of claim 16, wherein the power supply part further comprises a capacitor connected to the first output end, wherein the IC chip is configured to discharge the capacitor by turning on the transistor for a second threshold time based on the detected voltage decreasing to a voltage less than a second threshold value, which is less than the first threshold value.

* * * * *